US010810989B2

(12) United States Patent
Goldstein et al.

(10) Patent No.: US 10,810,989 B2
(45) Date of Patent: Oct. 20, 2020

(54) METHOD AND DEVICE FOR ACUTE SOUND DETECTION AND REPRODUCTION

(71) Applicant: Staton Techiya LLC, Delray Beach, FL (US)

(72) Inventors: Steven Wayne Goldstein, Delray Beach, FL (US); John Usher, Beer (GB); Marc Andre Boillot, Plantation, FL (US)

(73) Assignee: Staton Techiya LLC, Delray Beach, FL (US)

( * ) Notice: Subject to any disclaimer, the term of this patent is extended or adjusted under 35 U.S.C. 154(b) by 0 days.

(21) Appl. No.: 16/669,490

(22) Filed: Oct. 30, 2019

(65) Prior Publication Data

US 2020/0066247 A1 Feb. 27, 2020

Related U.S. Application Data

(63) Continuation of application No. 16/193,568, filed on Nov. 16, 2018, now Pat. No. 10,535,334, which is a continuation of application No. 14/574,589, filed on Dec. 18, 2014, now Pat. No. 10,134,377, which is a continuation of application No. 12/017,878, filed on Jan. 22, 2008, now Pat. No. 8,917,894.

(60) Provisional application No. 60/885,917, filed on Jan. 22, 2007.

(51) Int. Cl.

| | |
|---|---|
| ***G10K 11/178*** | (2006.01) |
| ***H04R 3/00*** | (2006.01) |
| ***H04R 1/10*** | (2006.01) |
| ***G10K 11/00*** | (2006.01) |
| ***H04R 29/00*** | (2006.01) |

(52) U.S. Cl.

CPC ..... *G10K 11/17827* (2018.01); *G10K 11/002* (2013.01); *H04R 1/1016* (2013.01); *H04R 1/1083* (2013.01); *H04R 3/002* (2013.01); *H04R 3/005* (2013.01); *H04R 29/001* (2013.01); *H04R 2225/41* (2013.01); *H04R 2460/05* (2013.01); *H04R 2499/11* (2013.01)

(58) Field of Classification Search

CPC ..... G10K 11/17827; G10K 11/02; H04R 1/1016; H04R 1/1083; H04R 3/002; H04R 3/005; H04R 29/001; H04R 2225/41; H04R 2460/05; H04R 2499/11

See application file for complete search history.

(56) References Cited

U.S. PATENT DOCUMENTS

| | | | | |
|---|---|---|---|---|
| 4,596,902 A * | 6/1986 | Gilman | ..... | H04R 25/505 381/320 |
| 5,721,783 A | 2/1998 | Anderson | | |
| 5,867,581 A | 2/1999 | Obara | | |
| 6,415,034 B1 | 7/2002 | Hietanen | | |
| 6,754,359 B1 * | 6/2004 | Svean | ..... | H04R 1/1083 381/313 |

(Continued)

*Primary Examiner* — Andrew L Sniezek

(74) *Attorney, Agent, or Firm* — Akerman LLP; Peter A. Chiabotti; Mammen (Roy) P. Zachariah, Jr.

(57) ABSTRACT

Earpieces and methods for acute sound detection and reproduction are provided. A method can include measuring an external ambient sound level (xASL), monitoring a change in the xASL for detecting an acute sound, estimating a proximity of the acute sound, and upon detecting the acute sound and its proximity, reproducing the acute sound within an ear canal, where the ear canal is at least partially occluded by an earpiece. Other embodiments are disclosed.

17 Claims, 9 Drawing Sheets

(56) References Cited

U.S. PATENT DOCUMENTS

| | | | | |
|---|---|---|---|---|
| 7,006,650 | B1 | 2/2006 | Wild | |
| 7,929,713 | B2 | 4/2011 | Victorian | |
| 8,077,892 | B2 | 12/2011 | Dijkstra | |
| 8,098,832 | B2 | 1/2012 | Lin | |
| 8,213,629 | B2 | 7/2012 | Goldstein et al. | |
| 8,229,127 | B2 | 7/2012 | Jorgensen | |
| 8,774,433 | B2 | 7/2014 | Goldstein | |
| 8,917,894 | B2 * | 12/2014 | Goldstein | H04R 1/1016 381/328 |
| 9,055,377 | B2 | 6/2015 | Kinsbergen | |
| 9,137,611 | B2 | 9/2015 | Unno | |
| 9,232,322 | B2 | 1/2016 | Fang | |
| 9,357,314 | B2 | 5/2016 | Goorevich | |
| 9,613,622 | B1 | 4/2017 | Melanson | |
| 10,134,377 | B2 * | 11/2018 | Goldstein | G10K 11/17827 |
| 10,535,334 | B2 * | 1/2020 | Goldstein | H04R 3/002 |
| 2001/0046304 | A1 | 11/2001 | Rast | |
| 2005/0058301 | A1 | 3/2005 | Brown | |
| 2005/0058313 | A1 | 3/2005 | Victorian et al. | |
| 2006/0002574 | A1 | 1/2006 | Shennib et al. | |
| 2006/0045282 | A1 | 3/2006 | Reber | |
| 2006/0083388 | A1 | 4/2006 | Rothchild | |
| 2006/0222194 | A1 | 10/2006 | Bramslow et al. | |
| 2006/0262938 | A1 | 11/2006 | Gauger, Jr. et al. | |
| 2007/0116310 | A1 | 5/2007 | Ludvigsen | |
| 2007/0189544 | A1 | 8/2007 | Rosenberg | |
| 2007/0223717 | A1 * | 9/2007 | Boersma | H04M 1/6058 381/74 |
| 2008/0159547 | A1 | 7/2008 | Schuler et al. | |
| 2008/0181442 | A1 | 7/2008 | Goldstein et al. | |
| 2008/0240458 | A1 | 10/2008 | Goldstein et al. | |
| 2008/0260191 | A1 | 10/2008 | Victorian et al. | |
| 2011/0195676 | A1 | 8/2011 | Victorian et al. | |
| 2012/0020485 | A1 | 1/2012 | Visser et al. | |
| 2016/0021469 | A1 | 1/2016 | Victorian et al. | |

* cited by examiner

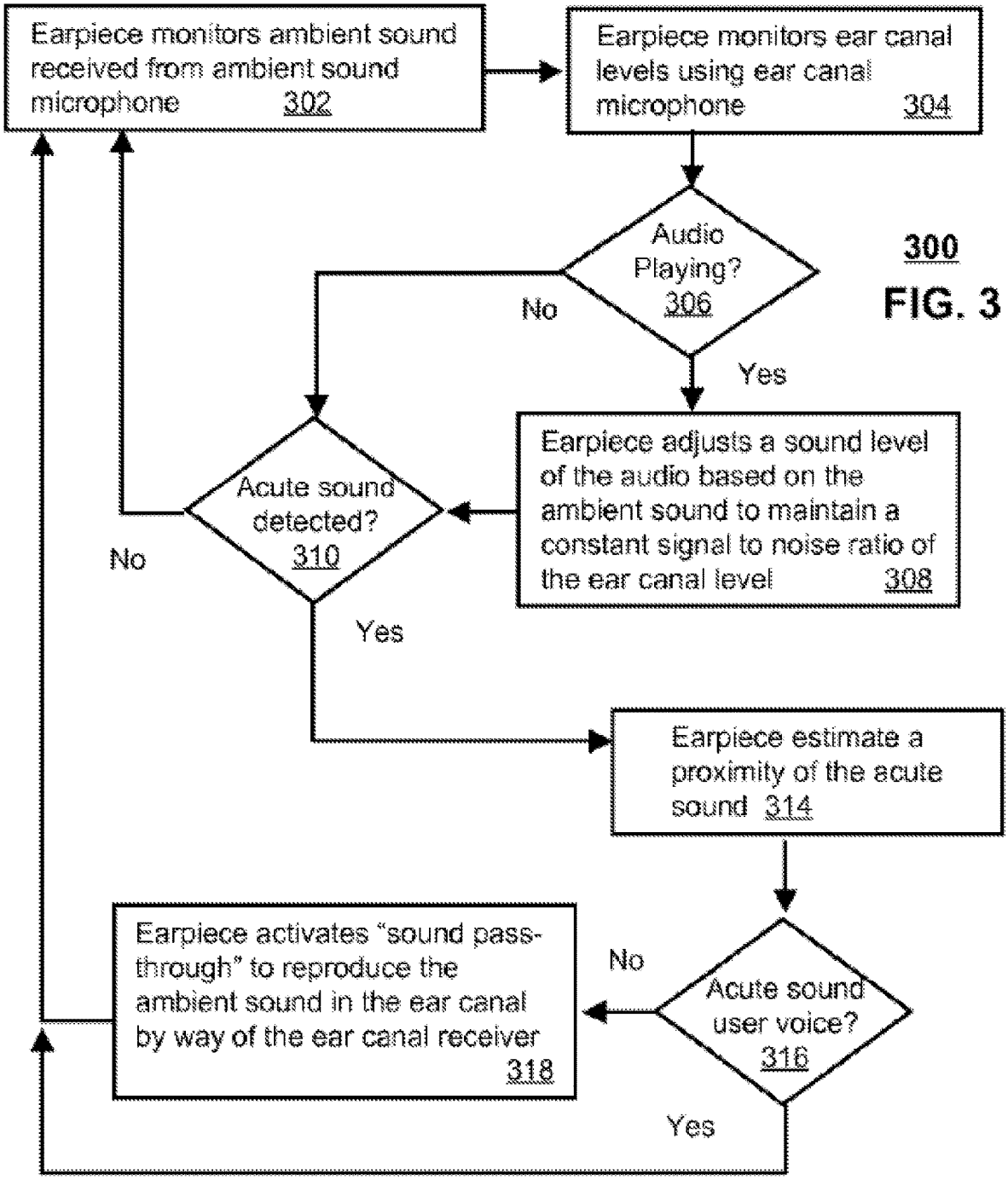
Earpiece monitors ambient sound received from ambient sound microphone 302
Earpiece monitors ear canal levels using ear canal microphone 304
Audio Playing? 306
No
Yes
300
FIG. 3
Earpiece adjusts a sound level of the audio based on the ambient sound to maintain a constant signal to noise ratio of the ear canal level 308
Acute sound detected? 310
No
Yes
Earpiece estimate a proximity of the acute sound 314
Acute sound user voice? 316
No
Yes
Earpiece activates "sound pass-through" to reproduce the ambient sound in the ear canal by way of the ear canal receiver 318

METHOD AND DEVICE FOR ACUTE SOUND DETECTION AND REPRODUCTION

CROSS-REFERENCE TO RELATED APPLICATION(S)

This application is a continuation of and claims priority to U.S. patent application Ser. No. 16/193,568, filed 16 Nov. 2018. U.S. patent application Ser. No. 16/193,568 is a continuation of and claims priority to U.S. patent application Ser. No. 14/574,589, filed on Dec. 18, 2014, which claims priority to and is a continuation of U.S. patent application Ser. No. 12/017,878, filed on Jan. 22, 2008, now U.S. Pat. No. 8,917,894, which claims the benefit of U.S. Provisional Patent Application Ser. No. 60/885,917, filed on Jan. 22, 2007, all of which are herein incorporated by reference in their entireties.

FIELD OF THE INVENTION

The present invention relates to a device that monitors sound directed to an occluded ear, and more particularly, though not exclusively, to an earpiece and method of operating an earpiece that detects acute sounds and allows the acute sounds to be reproduced in an ear canal of the occluded ear.

BACKGROUND

Since the advent of industrialization over two centuries ago, the human auditory system has been increasingly stressed to tolerate high noise levels to which it had hitherto been unexposed. Recently, human knowledge of the causes of hearing damage have been researched intensively and models for predicting hearing loss have been developed and verified with empirical data from decades of scientific research. Yet it can be strongly argued that the danger of permanent hearing damage is more present in our daily lives than ever, and that sound levels from personal audio systems in particular (i.e. from portable audio devices), live sound events, and the urban environment are a ubiquitous threat to healthy auditory functioning across the global population.

Environmental noise is constantly presented in industrialized societies given the ubiquity of external sound intrusions. Examples include people talking on their cell phones, blaring music in health clubs, or the constant hum of air conditioning systems in schools and office buildings. Excess noise exposure can also induce auditory fatigue, possibly comprising a person's listening abilities. On a daily basis, people are exposed to various environmental sounds and noises within their environment, such as the sounds from traffic, construction, and industry.

To combat the undesired cacophony of annoying sounds, people are arming themselves with portable audio playback devices to drown out intrusive noise. The majority of devices providing the person with audio content do so using insert (or in-ear) earbuds. These earbuds deliver sound directly to the ear canal at high sound levels over the background noise even though the earbuds generally provide little to no ambient sound isolation. Moreover, when people wear earbuds (or headphones) to listen to music, or engage in a call using a telephone, they can effectively impair their auditory judgment and their ability to discriminate between sounds. With such devices, the person is immersed in the audio experience and generally less likely to hear warning sounds within their environment. In some cases, the user may even turn up the volume to hear their personal audio over environmental noises. It also puts them at high sound exposure risk which can potentially cause long term hearing damage.

With earbuds, personal audio reproduction levels can reach in excess of 100 dB. This is enough to exceed recommended daily sound exposure levels in less than a minute and to cause permanent acoustic trauma. Furthermore, rising population densities have continually increased sound levels in society. According to researchers, 40% of the European community is continuously exposed to transportation noise of 55 dBA and 20% are exposed to greater than 65 dBA. This level of 65 dBA is considered by the World Health Organization to be intrusive or annoying, and as mentioned, can lead to users of personal audio devices increasing reproduction levels to compensate for ambient noise.

A need therefore exists for enhancing the user's ability to listen in the environment without harming his or her hearing faculties.

SUMMARY

Embodiments in accordance with the present invention provide a method and device for acute sound detection and reproduction.

In a first embodiment, an earpiece can include an Ambient Sound Microphone (ASM) to capture ambient sound, at least one Ear Canal Receiver (ECR) to deliver audio to an ear canal; and a processor operatively coupled to the ASM and the at least one ECR. The processor can monitor a change in the ambient sound level to detect an acute sound from the change. The acute sound can be reproduced within the ear canal via the ECR responsive to detecting the acute sound.

The processor can pass (transmit) sound from the ASM directly to the ECR to produce sound within the ear canal at a same sound pressure level (SPL) as the acute sound measured at an entrance to the ear canal. In one arrangement, the processor can maintain an approximately constant ratio between an audio content level (ACL) and an internal ambient sound level (iASL) measured within the ear canal. In one arrangement, the processor can measure an external ambient sound level (xASL) of the ambient sound with the ASM and subtract an attenuation level of the earpiece from the xASL to estimate the internal ambient sound level (iASL) within the ear canal.

The earpiece can further include an Ear Canal Microphone (ECM) to measure an ear canal sound level (ECL) within the ear canal. In this configuration, the processor can estimate the internal ambient sound level (iASL) within the ear canal by subtracting an estimated audio content sound level (ACL) from the ECL. For instance, the processor can measure a voltage level of the audio content sent to the ECR, and apply a transfer function of the ECR to convert the voltage level to the ACL. The processor can be located external to the earpiece on a portable computing device.

In a second embodiment, an earpiece can comprise an Ambient Sound Microphone (ASM) to capture ambient sound, at least one Ear Canal Receiver (ECR) to deliver audio to an ear canal, an audio interface operatively coupled to the processor to receive audio content, and a processor operatively coupled to the ASM and the at least one ECR. The processor can monitor a change in the ambient sound level to detect an acute sound from the change, adjust an audio content level (ACL) of the audio content delivered to the ear canal, and reproduce the acute sound within the ear canal via the ECR responsive to detecting the acute sound and based on the ACL.

The audio interface can receive the audio content from at least one among a portable music player, a cell phone, and a portable communication device. During operation, the processor can maintain an approximately constant ratio between an audio content level (ACL) and an internal ambient sound level (iASL) measured within the ear canal. In one arrangement, the processor can mute the audio content and pass the acute sound to the ECR for reproducing the acute sound within the ear canal. In another arrangement, the processor can amplify the acute sound with respect to the audio content level (ACL).

In a third embodiment, a method for acute sound detection and reproduction can include the steps of measuring an ambient sound level (xASL) of ambient sound external to an ear canal at least partially occluded by the earpiece, monitoring a change in the xASL for detecting an acute sound, and reproducing the acute sound within the ear canal responsive to detecting the acute sound. The reproducing can include enhancing the acute sound over the ambient sound. The step of reproducing can produce sound within the ear canal at a same sound pressure level (SPL) as the acute sound measured at an entrance to the ear canal.

The method can further include receiving audio content from an audio interface that is directed to the ear canal, and maintaining an approximately constant ratio between a level of the audio content (ACL) and a level of an internal ambient sound level (iASL) measured within the ear canal. The ACL can be determined by measuring a voltage level of the audio content sent to the ECR, and applying a transfer function of the ECR to convert the voltage level to the ACL. The method can further include measuring an Ear Canal Level (ECL) within the ear canal, and subtracting the ACL from the ECL to estimate the iASL. The iASL can be estimated by subtracting an attenuation level of the earpiece from the xASL.

In a fourth embodiment, a method for acute sound detection and reproduction suitable for use with an earpiece can include the steps of measuring an external ambient sound level (xASL) in an ear canal at least partially occluded by the earpiece, monitoring a change in the xASL for detecting an acute sound, estimating a proximity of the acute sound, and reproducing the acute sound within the ear canal responsive to detecting the acute sound based on the proximity. The step of estimating a proximity can include performing a cross correlation analysis between at least two microphones, identifying a peak in the cross correlation and an associated time lag, and determining the direction from the associated time lag. The method can further include identifying whether the acute sound is a vocal signal produced by a user operating the earpiece or a sound source external from the user.

In a fifth embodiment, a method for acute sound detection and reproduction suitable for use with an earpiece can include measuring an external ambient sound level (xASL) due to ambient sound outside of an ear canal at least partially occluded by the earpiece, measuring an internal ambient sound level (iASL) due to residual ambient sound within the ear canal at least partially occluded by the earpiece, monitoring a high frequency change between the xASL and the iASL with respect to a low frequency change between the xASL and the iASL for detecting an acute sound, and reproducing the xASL within the ear canal responsive to detecting the high frequency change. The method can further include determining a proximity of a sound source producing the acute sound.

BRIEF DESCRIPTION OF THE DRAWINGS

FIG. 3 is a flowchart of a method for acute sound detection in accordance with an exemplary embodiment;

DETAILED DESCRIPTION

Figure 1:
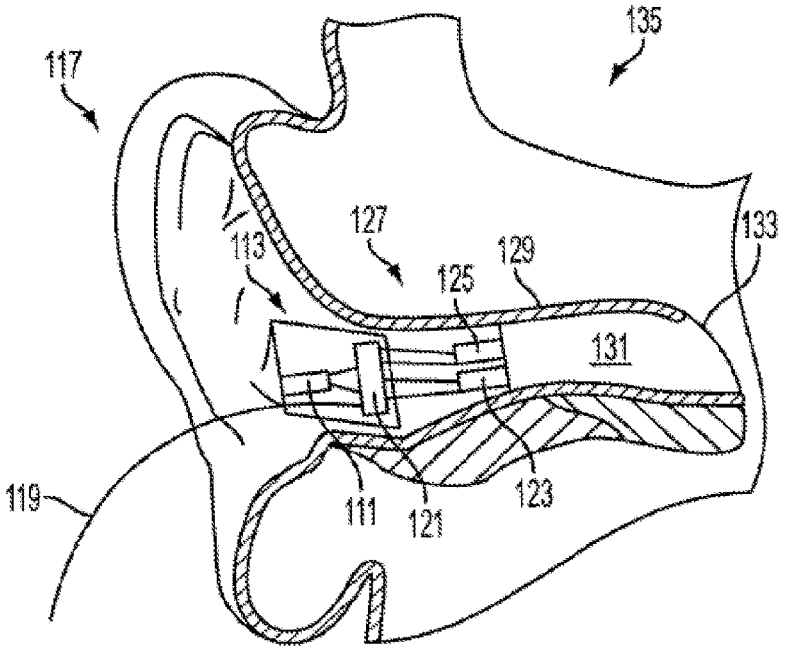
FIG. 1 is a pictorial diagram of an earpiece in accordance with an exemplary embodiment.

The following description of at least one exemplary embodiment is merely illustrative in nature and is in no way intended to limit the invention, its application, or uses.

Processes, techniques, apparatus, and materials as known by one of ordinary skill in the relevant art may not be discussed in detail but are intended to be part of the enabling description where appropriate, for example the fabrication and use of transducers. Additionally in at least one exemplary embodiment the sampling rate of the transducers can be varied to pick up pulses of sound, for example less than 50 milliseconds.

In all of the examples illustrated and discussed herein, any specific values, for example the sound pressure level change, should be interpreted to be illustrative only and non-limiting. Thus, other examples of the exemplary embodiments could have different values.

Note that similar reference numerals and letters refer to similar items in the following figures, and thus once an item is defined in one figure, it may not be discussed for following figures.

Note that herein when referring to correcting or preventing an error or damage (e.g., hearing damage), a reduction of the damage or error and/or a correction of the damage or error are intended.

At least one exemplary embodiment of the invention is directed to an earpiece for ambient sound monitoring and warning detection. Reference is made to FIG. 1 in which an earpiece device, generally indicated as earpiece 100, is constructed in accordance with at least one exemplary embodiment of the invention. As illustrated, earpiece 100 depicts an electro-acoustical assembly 113 for an in-the-ear acoustic assembly, as it would typically be placed in the ear canal 131 of a user 135. The earpiece 100 can be an in the ear earpiece, behind the ear earpiece, receiver in the ear, open-fit device, or any other suitable earpiece type. The earpiece 100 can be partially or fully occluded in the ear canal, and is suitable for use with users having healthy or abnormal auditory functioning.

Earpiece 100 includes an Ambient Sound Microphone (ASM) Ill to capture ambient sound, an Ear Canal Receiver (ECR) 125 to deliver audio to an ear canal 131, and an Ear Canal Microphone (ECM) 123 to assess a sound exposure level within the ear canal. The earpiece 100 can partially or fully occlude the ear canal 131 to provide various degrees of acoustic isolation. The assembly is designed to be inserted into the user's ear canal 131, and to form an acoustic seal with the walls 129 of the ear canal at a location 127 between the entrance 117 to the ear canal and the tympanic membrane (or ear drum) 133. Such a seal is typically achieved by means of a soft and compliant housing of assembly 113. Such a seal is pertinent to the performance of the system in that it creates a closed cavity 131 of approximately 5 cc between the in-ear assembly 113 and the tympanic membrane 133. As a result of this seal, the ECR (speaker) 125 is able to generate a full range bass response when reproducing sounds for the user. This seal also serves to significantly reduce the sound pressure level at the user's eardrum 133 resulting from the sound field at the entrance to the ear canal. This seal is also the basis for the sound isolating performance of the electro-acoustic assembly 113.

Located adjacent to the ECR 125, is the ECM 123, which is acoustically coupled to the (closed) ear canal cavity 131. One of its functions is that of measuring the sound pressure level in the ear canal cavity 131 as a part of testing the hearing acuity of the user as well as confirming the integrity of the acoustic seal and the working condition of itself and the ECR. The ASM Ill is housed in an assembly 113 and monitors sound pressure at the entrance to the occluded or partially occluded ear canal. All transducers shown can receive or transmit audio signals to a processor 121 that undertakes audio signal processing and provides a transceiver for audio via the wired or wireless communication path 119.

Figure 2:
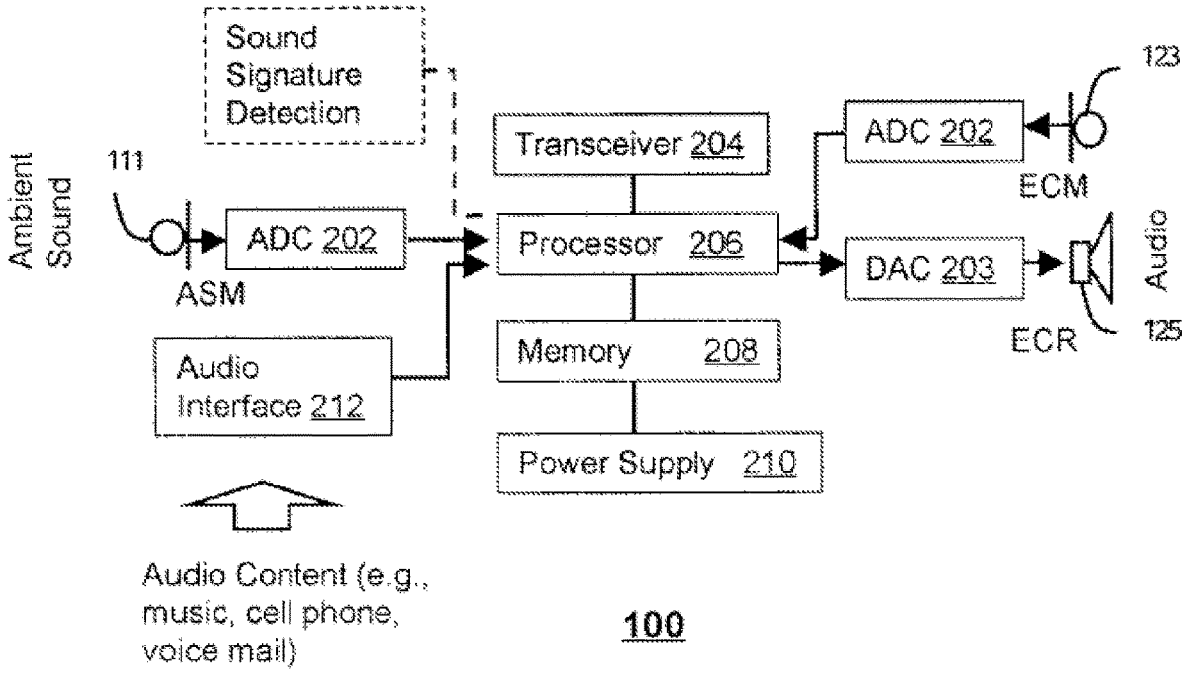
FIG. 2 is a block diagram of the earpiece in accordance with an exemplary embodiment.

Referring to FIG. 2, a block diagram of the earpiece 100 in accordance with an exemplary embodiment is shown. As illustrated, the earpiece 100 can include a processor 206 operatively coupled to the ASM 111, ECR 125, and ECM 123 via one or more Analog to Digital Converters (ADC) 202 and Digital to Analog Converters (DAC) 203. The processor 206 can monitor the ambient sound captured by the ASM 111 for acute sounds in the environment, such as an abrupt high energy sound corresponding to the on-set of a warning sound (e.g., bell, emergency vehicle, security system, etc.), siren (e.g., police car, ambulance, etc.), voice (e.g., "help", "stop", "police", etc.), or specific noise type (e.g., breaking glass, gunshot, etc.). The processor 206 can utilize computing technologies such as a microprocessor, Application Specific Integrated Chip (ASIC), and/or digital signal processor (DSP) with associated storage memory 208 such as Flash, ROM, RAM, SRAM, DRAM or other like technologies for controlling operations of the earpiece device 100. The memory 208 can store program instructions for execution on the processor 206 as well as captured audio processing data.

The earpiece 100 can include an audio interface 212 operatively coupled to the processor 206 to receive audio content, for example from a media player or cell phone, and deliver the audio content to the processor 206. The processor 206 responsive to detecting acute sounds can adjust the audio content and pass the acute sounds directly to the ear canal. For instance, the processor can lower a volume of the audio content responsive to detecting an acute sound for transmitting the acute sound to the ear canal. The processor 206 can also actively monitor the sound exposure level inside the ear canal and adjust the audio to within a safe and subjectively optimized listening level range.

The earpiece 100 can further include a transceiver 204 that can support singly or in combination any number of wireless access technologies including without limitation Bluetooth™, Wireless Fidelity (WiFi), Worldwide Interoperability for Microwave Access (WiMAX), and/or other short or long range communication protocols. The transceiver 204 can also provide support for dynamic downloading over-the-air to the earpiece 100. It should be noted also that next generation access technologies can also be applied to the present disclosure.

The power supply 210 can utilize common power management technologies such as replaceable batteries, supply regulation technologies, and charging system technologies for supplying energy to the components of the earpiece 100 and to facilitate portable applications. A motor (not shown) can be a single supply motor driver coupled to the power supply 210 to improve sensory input via haptic vibration. As an example, the processor 206 can direct the motor to vibrate responsive to an action, such as a detection of a warning sound or an incoming voice call.

The earpiece 100 can further represent a single operational device or a family of devices configured in a master-slave arrangement, for example, a mobile device and an earpiece. In the latter embodiment, the components of the earpiece 100 can be reused in different form factors for the master and slave devices.

FIG. 3 is a flowchart of a method 300 for acute sound detection and reproduction in accordance with an exemplary embodiment. The method 300 can be practiced with more or less than the number of steps shown and is not limited to the order shown. To describe the method 300, reference will be made to components of FIG. 2, although it is understood that the method 300 can be implemented in any other manner using other suitable components. The method 300 can be implemented in a single earpiece, a pair of earpieces, headphones, or other suitable headset audio delivery devices.

The method 300 can start in a state wherein the earpiece 100 has been inserted and powered on. As shown in step 302, the earpiece 100 can monitor the environment for ambient sounds received at the ASM 111. Ambient sounds correspond to sounds within the environment such as the sound of traffic noise, street noise, conversation babble, or any other acoustic sound. Ambient sounds can also correspond to industrial sounds present in an industrial setting, such as factory noise, lifting vehicles, automobiles, and robots to name a few.

Although the earpiece 100 when inserted in the ear can partially occlude the ear canal, the earpiece 100 may not completely attenuate the ambient sound. During the monitoring of ambient sounds in the environment, the earpiece 100 also monitors ear canal levels via the ECM 123 as shown in step 304. The passive aspect of the physical earpiece 100, due to the mechanical and sealing properties, can provide upwards of a 22-26 dB noise reduction. However, portions of ambient sounds higher than 26 dB can still pass through the earpiece 100 into the ear canal. For instance, high energy low frequency sounds are not completely attenuated. Accordingly, residual sound may be resident in the ear canal and heard by the user.

Sound within the ear canal 131 can also be provided via the audio interface 212. The audio interface 212 can receive the audio content from at least one among a portable music player, a cell phone, and a portable communication device. The audio interface 212 responsive to user input can direct sound to the ECR 125. For instance, a user can elect to play music through the earpiece 100 which can be audibly presented to the ear canal 131 for listening. The user can also elect to receive voice communications (e.g., cell phone, voice mail, messaging) via the earpiece 100. For instance, the user can receive audio content for voice mail or a phone call directed to the ear canal via the ECR 125. As shown in step 304, the earpiece 100 an monitor ear canal levels due to ambient sound and user selected sound via the ECM 123.

If at step 306, audio is playing (e.g., music, cell phone, etc.), the earpiece 100 adjusts a sound level of the audio based on the ambient sound to maintain a constant signal to noise ratio with respect to the ear canal level at step 308. For instance, the processor 206 can selectively amplify or attenuate audio content received from the audio interface 212 before it is delivered to the ECR 125. The processor 206 estimates a background noise level from the ambient sound received at the ASM Ill, and adjusts the audio level of delivered audio content (e.g., music, cell phone audio) to maintain a constant signal (e.g., audio content) to noise level (e.g., ambient sound). By way of example, if the background noise level increases due to traffic sounds, the earpiece 100 automatically increases the volume of the audio content. Similarly, if the background noise level decreases, the earpiece 100 automatically decreases the volume of the audio content. The processor 206 can track variations on the ambient sound level to adjust the audio content level.

If at step 310, an acute sound is detected within the ambient sound, the earpiece 100 activates "sound pass-through" to reproduce the ambient sound in the ear canal by way of the ECR 125. The processor 206 permits the ambient sound to pass through the ECR 125 to the ear canal 131 directly for example by replicating the ambient sound external to the ear canal within the ear canal. This is important if the acute sound corresponds to an on-set for a warning sound such as a bell, a car, or an object. In such regard, the ambient sound containing the acute sound is presented directly to the ear canal in an original form. Although, the earpiece 100 inherently provides attenuation due to the physical and mechanical aspects of the earpiece and its sealing properties, the processor 206 can reproduce the ambient sound within the ear canal 131 at an original amplitude level and frequency content to provide "transparency". For instance, the processor 206 measures and applies a transfer function of the ear canal to the passed ambient sound signal to provide an accurate reproduction of the ambient sound within the ear canal.

In one embodiment, the earpiece 100 looks for temporal and spectral characteristics in the ambient sound for detecting acute sounds. For instance, as will be explained ahead, the processor 206 looks for an abrupt change in the Sound Pressure Level (SPL) of an ambient sound across a small time period. The processor 206 can also detect abrupt magnitude changes across frequency sub-bands (e.g. filter-bank, FFT, etc.). Notably, the processor 206 can search for on-sets (e.g., fast rising amplitude wave-front) of an acute sound or other abrupt feature characteristics without initially attempting to initially identify or recognize the sound source. That is, the processor 206 is actively listening for a presence of acute sounds before identifying the type of sound source.

Even though the earplug inherently provides a certain attenuation level (e.g., noise reduction rating), the processor 206 in view of the ear canal level (ECL) and ambient sound level (ASL) can reproduce the ambient sound within the ear canal to allow the user to make an informed decision with regard to the acute sound. The ECL corresponds to all sounds within the ear canal and includes the internal ambient sound level (iASL) resulting from residual ambient sounds through the earpiece and the audio content level (ACL) resulting from the audio delivered via the audio interface 212. Briefly, xASL is the external ambient sound external to the ear canal and the earpiece (e.g., ambient sound outside the ear canal). iASL is the residual ambient sound that remains internal in the ear canal. The following equations describe the relationship among terms:

$$iASL = xASL - NRR \quad \text{(EQ 1)}$$

$$iASL = ECL - ACL \quad \text{(EQ 2)}$$

As EQ 1 shows, the iASL is the difference between the external ambient sound (xASL) and the attenuation of the earpiece (Noise Reduction Rating) due to the physical and sealing properties of the earpiece. The processor 206 can measure an external ambient sound level (xASL) of the ambient sound with the ASM Ill and subtracts an attenuation level of the earpiece (NRR) from the xASL to estimate the internal ambient sound level (iASL) within the ear canal.

EQ 2 is an alternate, or supplemental, method for calculating the iASL as the difference between the ECL and the Audio Content Level (ACL). By way of the ECM 123, the processor 206 can estimate an internal ambient sound level (iASL) within the ear canal by subtracting the estimated audio content sound level (ACL) from the ECL. The processor 206 measures a voltage level of the audio content sent to the ECR 125, and applies a transfer function of the ECR 125 to convert the voltage level to the ACL.

The processor 206 evaluates the equations above to pass sound from the ASM Ill directly to the ECR 125 to produce sound within the ear canal at a same sound pressure level (SPL) and frequency representation as the acute sound measured at an entrance to the ear canal. Further, the processor 206 can maintain an approximately constant ratio between an audio content level (ACL) and an internal ambient sound level (iASL) measured within the ear canal.

At step 314, the earpiece 100 can estimate a proximity of the acute sound. For instance, as will be shown ahead, the processor 206 can perform a correlation analysis on at least two microphones to determine whether the sound source is internal (e.g., the user) or external (e.g., an object other than the user). At step 316, the earpiece 100 determines whether it is the user's voice that generates the acute sound when the user speaks, or whether it is an external sound such as a vehicle approaching the user. If at step 316, the processor 206 determines that the acute sound is a result of the user speaking, the processor 206 does not activate a pass-through mode, since this is not considered an external warning sound. The pass-through mode permits ambient sound detected at the ASM Ill to be transmitted directly to the ear canal. If however, the acute sound corresponds to an external sound source, such as an on-set of a warning sound, the earpiece at step 318 activates "sound pass-through" to reproduce the ambient sound in the ear canal by way of the ECR 125. The earpiece 100 can also present an audible notification to the user indicating that an external sound source generating the acute sound has been detected. The method 300 can proceed back to step 302 to continually monitor for acute sounds in the environment.

Figure 4:
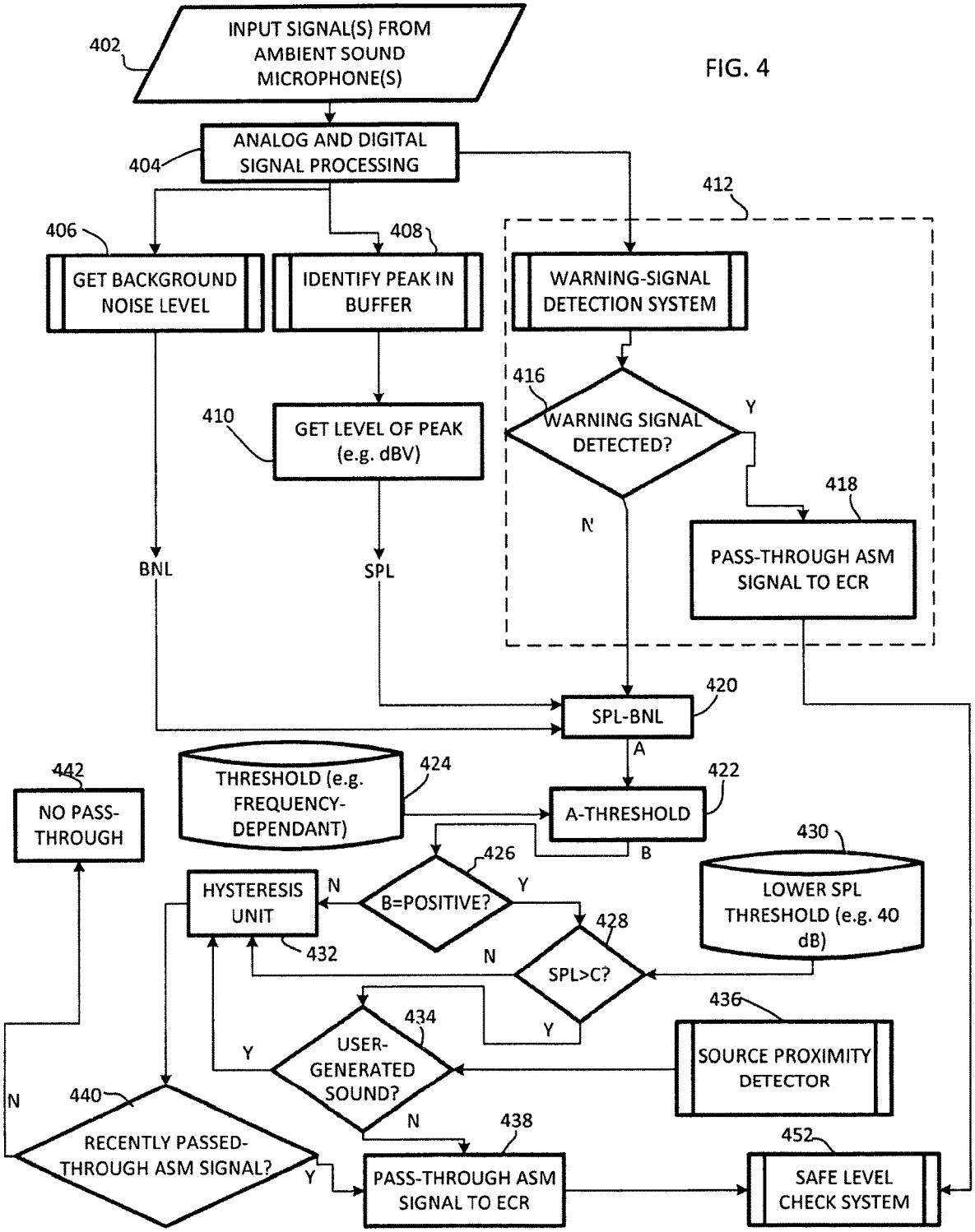
FIG. 4 is a more detailed approach to the method of FIG. 3 in accordance with an exemplary embodiment.

FIG. 4 is a detailed approach to the method 400 of FIG. 3 for an Acute-Sound Pass-Through System (ACPTS) in accordance with an exemplary embodiment. The method 400 can be practiced with more or less than the number of steps shown and is not limited to the order shown. To describe the method 400, reference will be made to components of FIG. 2, although it is understood that the method 400 can be implemented in any other manner using other suitable components. The method 400 can be implemented in a single earpiece, a pair of earpieces, headphones, or other suitable headset audio delivery devices.

At step 402, the earpiece 100 captures ambient sound signals from the ASM 111. At step 404, the processor 206 applies analog and discrete time signal processing to condition and compensate the ambient sound signal for the ASM 111 transducer. At step 406, the processor 206 estimates a background noise level (BNL) as will be discussed ahead. At step 408, the processor 206 identifies at least one peak in a data buffer storing a portion of the ambient sound signal. The processor 206 at step 410 gets a level of the peak (e.g., dBV). Block 412 presents a method for warning signal detection (e.g. car horns, klaxons). When a warning signal is detected at step 416, the processor 206 invokes at step 418 a pass-through mode whereby the ASM signal is reproduced with the ECR 125. Upon activating pass-through mode, the processor 206 can perform a safe level check at step 452. If a warning signal is not detected, the method 400 proceeds to step 420.

At step 420, the processor 206 subtracts the estimated BNL from an SPL of the ambient sound signal to produce signal "A". A high energy level transient signal is indicative of an acute sound. At step 422, a frequency dependent threshold is retrieved at step 424, and subtracted from signal "A", as shown in step 422 to produce signal "B". At step 426, the processor 206 determines if signal "B" is positive. If not, the processor 206 performs a hysterisis to determine if the acute sound has already been detected. If not, the processor at step 428 determines if an SPL of the ambient sound is greater than a signal "C" (e.g. threshold). If the SPL is greater than signal "C", the earpiece generates a user generated sound at step 434. The signal "C" is used to ensure that the SPL between the signal and background noise is positive and greater than a predetermined amount. For instance, a low SPL threshold (e.g., "C" 40 dB) can be used as shown in step 430, although it can adapt to different environmental conditions. The low SPL threshold provides an absolute measure to the SPL difference. At step 436, a proximity of a sound source generating the acute sound can be estimated as will be discussed ahead. The method 400 can continue to step 432.

Briefly, if a transient, high-level sound (or acute sound) is detected in the ambient sound signal (ASM input signal), then it is converted to a level, and its magnitude compared with the BNL is calculated. The magnitude of this resulting difference (signal "A") is compared with the threshold (see step 422). If the value is positive, and the level of the transient is greater than a predefined threshold (see step 428), the processor 206 invokes the optional Source Proximity Detector at step 436, which determines if the acute sound was created by the User's voice (i.e., a user generated sound). If a user-generated sound is NOT detected, then Pass-through operation at step 438 is invoked, whereby the ambient sound signal is reproduced with the ECR 125. If the difference signal at step 428 is not positive, or the level of the identified transient is too low, then the hysteresis is invoked at step 432. The processor 206 decides if the pass-through was recently used at step 440 (e.g. in the last 10 ms). If pass-through mode was recently activated, then processor 206 invokes the pass-through system at step 438; otherwise there is no pass-through of the ASM signal to the ECR as shown at step 442. Upon activating pass-through mode, the processor 206 can perform a safe level check at step 452.

Figure 5:
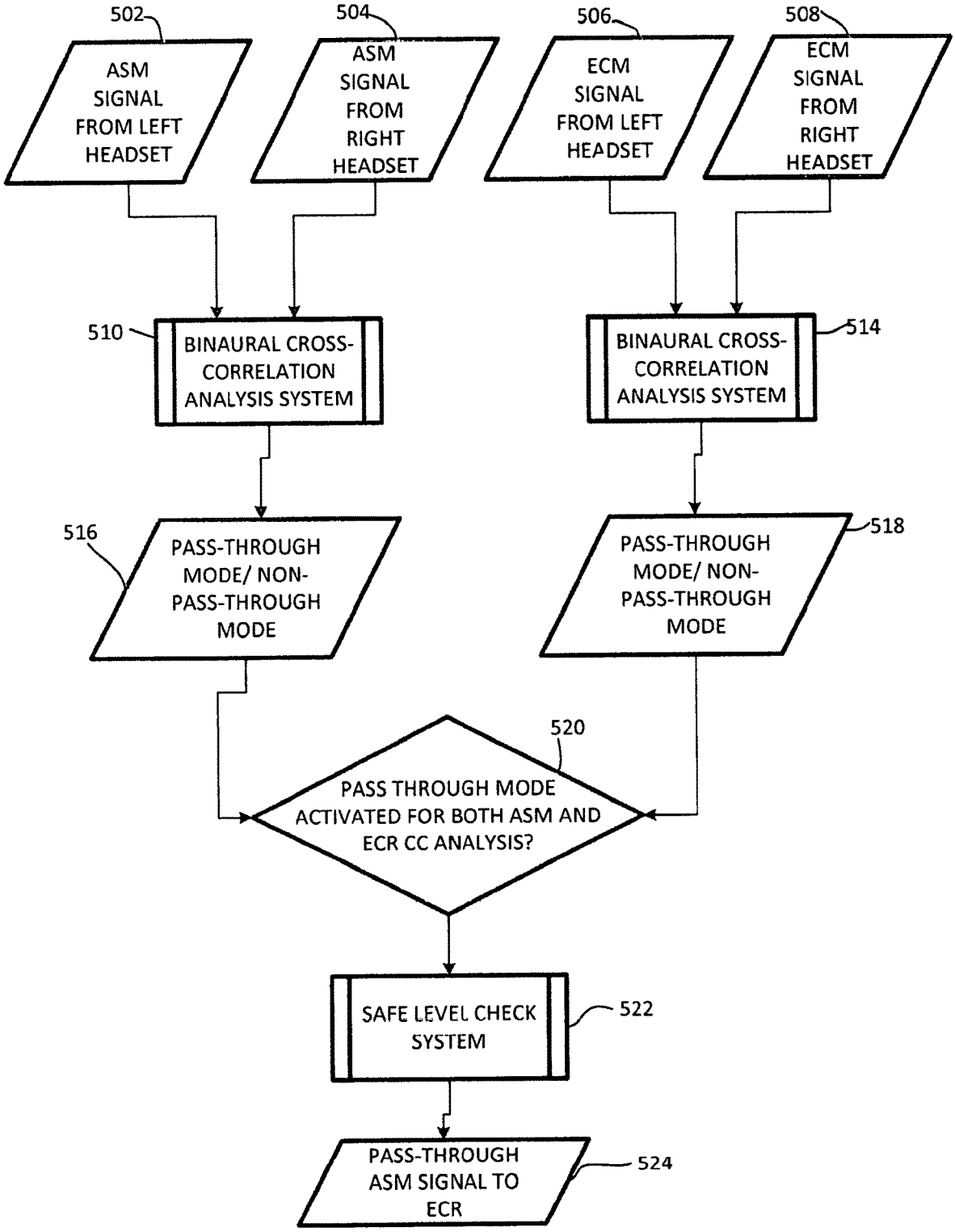
FIG. 5 is a flowchart of a method for acute sound source proximity in accordance with an exemplary embodiment.

FIG. 5 is a flowchart of a method 500 for acute sound source proximity. The method 500 can be practiced with more or less than the number of steps shown and is not limited to the order shown. To describe the method 500, reference will be made to components of FIG. 2, although it is understood that the method 500 can be implemented in any other manner using other suitable components. The method 500 can be implemented in a single earpiece, a pair of earpieces, headphones, or other suitable headset audio delivery devices.

Briefly, FIG. 5 describes a method 500 for Source Proximity Detection (SPD) to determine if the Acute sound detected was created by the User's voice operating the earpiece 100. The SPD method 500 uses as its inputs the external ambient sound signals from left and right electro-acoustic earpiece 100 assemblies (e.g., a headphone). In some embodiments the SPD method 500 employs Ear Canal Microphone (ECM) signals from left and right earpiece 100 assemblies placed on left and right ears respectively. The processor 206 performs an electronic cross-correlation between the external ambient sound signals to determine a Pass-through or Non Pass-through operating mode. In the described embodiment whereby the cross-correlation of both the ASM and ECM signals is involved, a pass-through mode is invoked when the cross-correlation analysis for both the left and right earpiece 100 assemblies return a "Pass-through" operating mode, as determined by a logical AND unit.

For instance, at step 502 a left ASM signal from a left headset incorporating the earpiece 100 assembles is received. Simultaneously, at step 504 a right ASM signal from a right headset is received. At step 510, the processor 206 performs a binaural cross correlation on the left ASM signal and the right ASM signal to evaluate a pass through mode 516. At step 506 a left ECM signal from the left headset is received. At step 508, a right ECM signal from the right headset is received. At step 514, the processor 206 performs a binaural cross correlation on the left ECM signal and the right ECM signal to evaluate a pass through mode 518. A pass through mode 524 is invoked if both the ASM and ECM cross correlation analysis are the same as determined in step 520. A safe level check can be performed by processor 206 at step 522.

Figure 6:
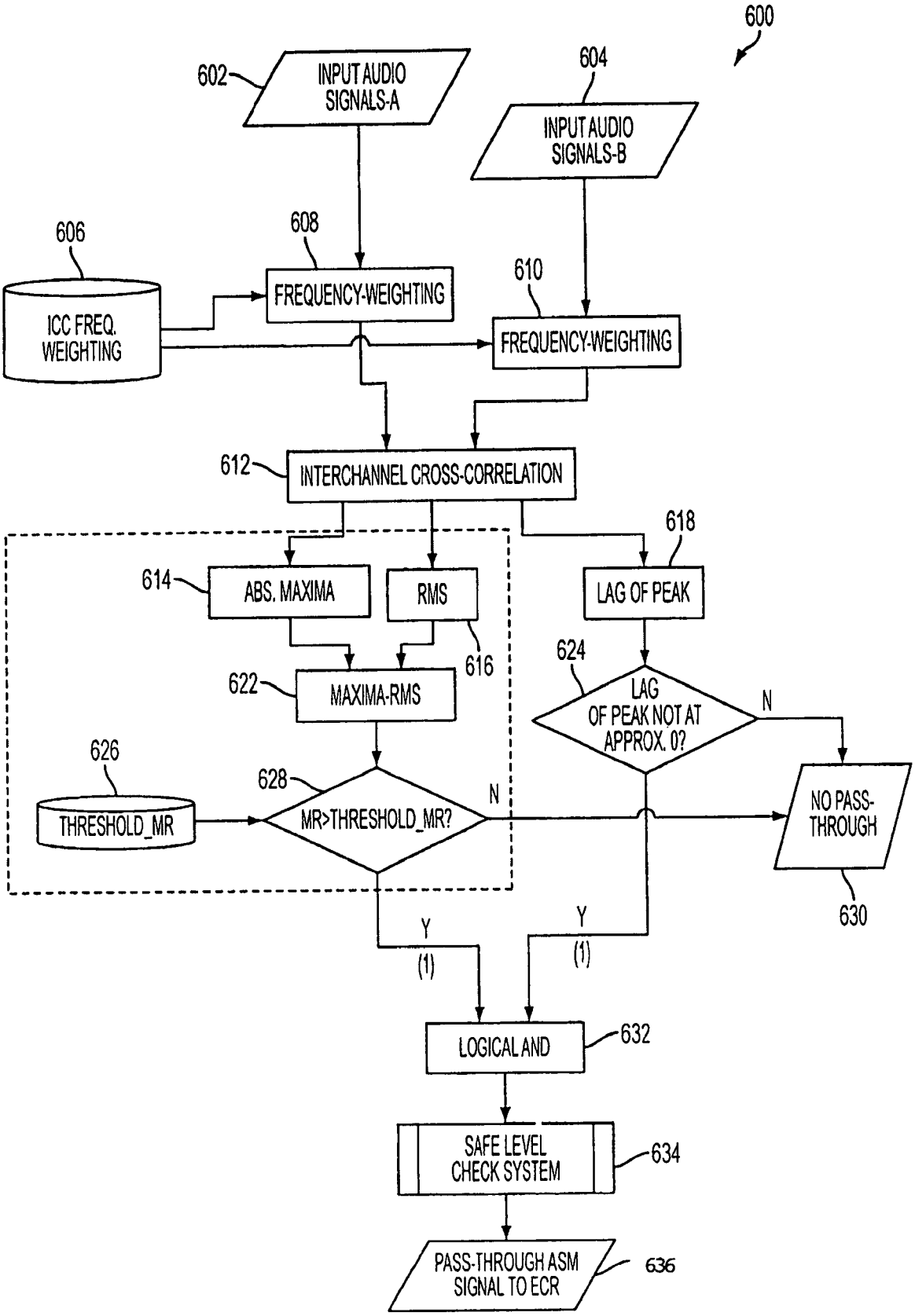
FIG. 6 is a flowchart of a method for binaural analysis in accordance with an exemplary embodiment.

FIG. 6 is a flowchart of a method 600 for binaural analysis. The method 600 can be practiced with more or less than the number of steps shown and is not limited to the order shown. To describe the method 600, reference will be made to components of FIG. 2, although it is understood that the method 600 can be implemented in any other manner using other suitable components. The method 600 can be implemented in a single earpiece, a pair of earpieces, headphones, or other suitable headset audio delivery devices.

Briefly, FIG. 6 describes a component of the SPD method 500 wherein a cross-correlation of two input audio signals 602 and 604 (e.g., left and right ASM signals) is calculated. The input signals may first be weighted using a frequency-dependant filter (e.g. an FIR-type filter) using filter coefficients 606 and filtering networks 608 and 610. Alternatively, an interchannel cross-correlation calculated with function 612 can return a frequency-dependant correlation such as a coherence function. The absolute maximum peak of a calculated cross-correlation 614 can be subtracted from a mean (or RMS) 616 correlation, with subtractor 622, and compared 628 with a predefined threshold 626, to determine if the peak is significantly greater than the average correlation (i.e. a test for peakedness). Alternatively, the maxima of the peak may simply be compared with the threshold 628 without the subtraction process 622. If the lag-time of the peak 618 is at approximately lag-sample 0, then the sound source is determined, at step 624, as being on the interaural axis-indicative of User-generated speech, and a no-pass through mode is returned 630 (a further function described in FIG. 7 may be used to confirm that the sound source originates in the User-head, rather than external to the user- and further confirming that the acute sound is a User-generated voice sound). The logical AND unit 632 activates the pass-through mode 636 if both criteria in the decision units 628 and 624 confirm that the absolute maxima of the peak is above a predefined threshold 626, AND the lag of the peak is NOT at approximately lag sample zero. A safe level check may be performed by processor 206 at step 634.

Figure 7:
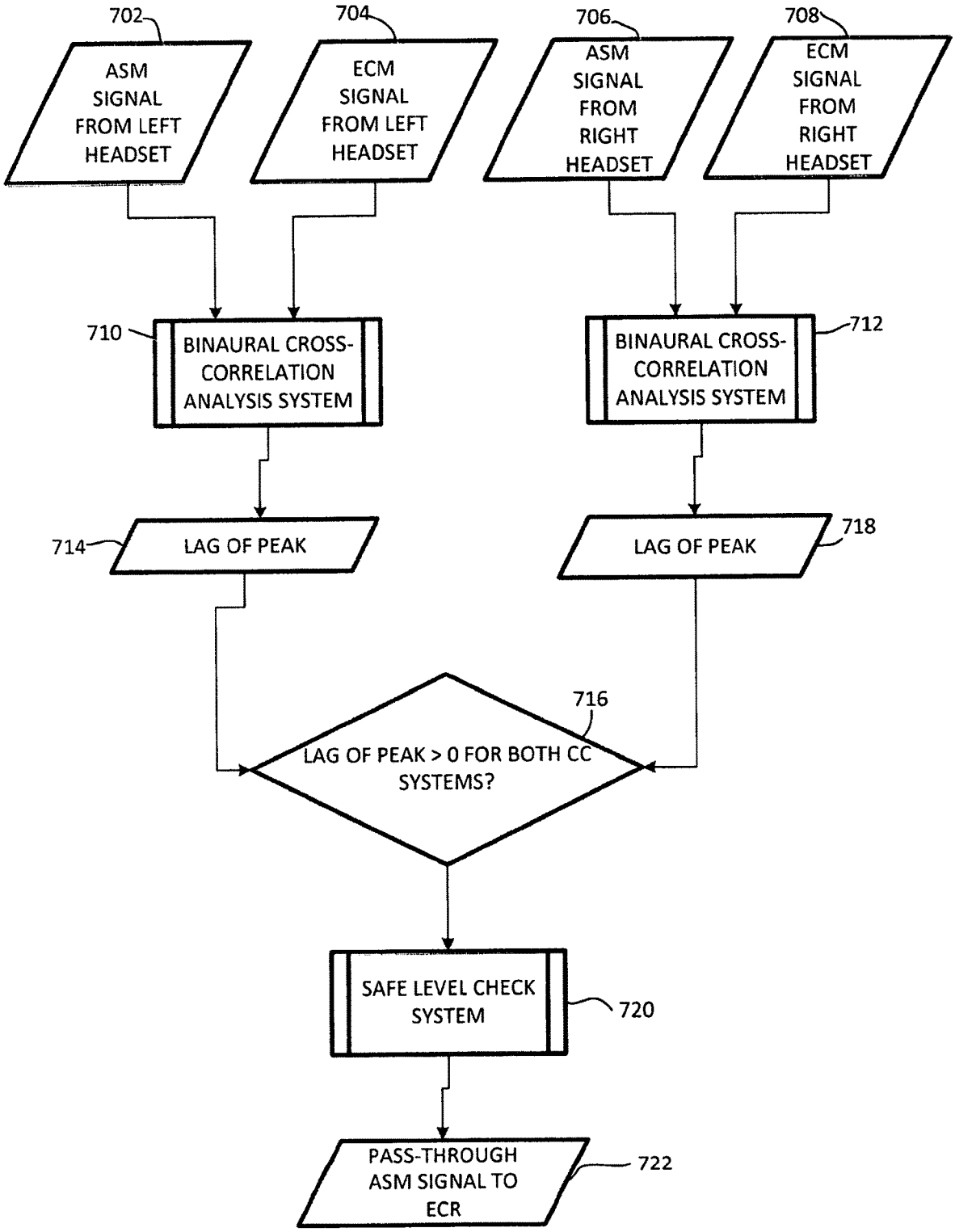
FIG. 7 is a flowchart of a method for logic control in accordance with an exemplary embodiment.

FIG. 7 is a flowchart of a method 700 for logic control. The method 700 can be practiced with more or less than the number of steps shown and is not limited to the order shown. To describe the method 700, reference will be made to components of FIG. 2, although it is understood that the method 700 can be implemented in any other manner using other suitable components. The method 700 can be implemented in a single earpiece, a pair of earpieces, headphones, or other suitable headset audio delivery devices.

Briefly, FIG. 7 describes a further component of the SPD method 500, which is optional to confirm that the acute sound source is from a location indicative of user-generated speech; i.e. inside the head. Method steps 702-712 are similar to Method steps 502-514 of FIG. 5. The cross-correlations of step 710 and 712 provide a time-lag of the maximum absolute peak for a pair of input signals; the ASM and ECM signals for the same headset (e.g. the ASM and ECM for the left headset). At step 714 a left lag of a peak of the left cross correlation is determined, and simultaneously, a right lag of a peak of the right cross correlation is determined at step 718. If a lag of a respective peak is greater than zero—this indicates that the sound arrived at the ECM signal before the ASM signal. Decision step 716 determines if the lag is greater than zero for both the left and right headsets- and activates the pass-through mode 722 if so. A safe level check may be performed by processor 206 at step 720.

Figure 8:
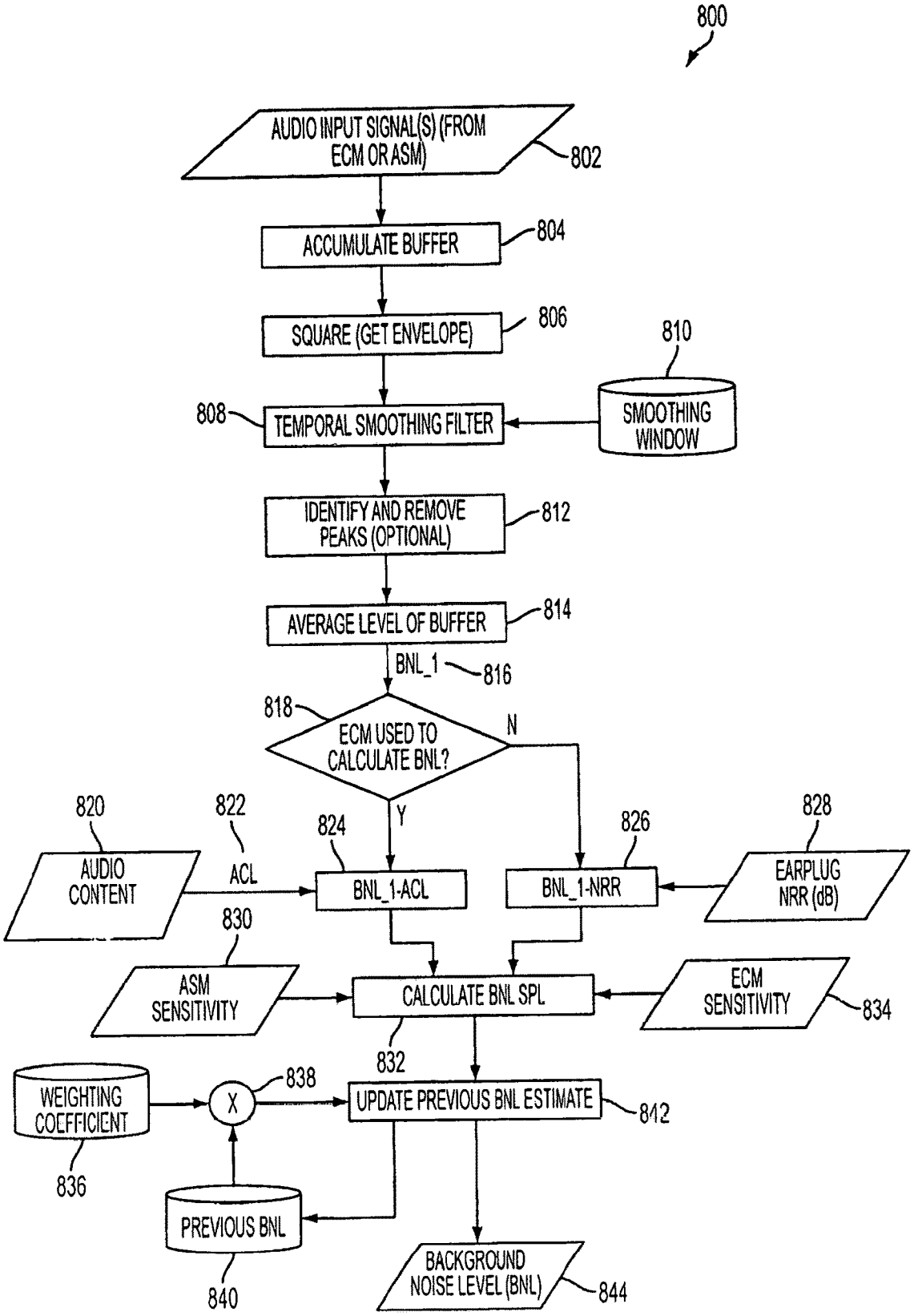
FIG. 8 is a flowchart of a method for estimating background noise level in accordance with an exemplary embodiment.

FIG. 8 is a flowchart of a method 800 for estimating background sound level. The method 800 can be practiced with more or less than the number of steps shown and is not limited to the order shown. To describe the method 800, reference will be made to components of FIG. 2, although it is understood that the method 800 can be implemented in any other manner using other suitable components. The method 800 can be implemented in a single earpiece, a pair of earpieces, headphones, or other suitable headset audio delivery devices.

Briefly, method 800 receives as its input 802 either or both the ASM signal from ASM Ill and a signal from the ECM 123. An audio buffer 804 of the input audio signal is accumulated (e.g. 10 ms of data), which is then processed by squaring step 806 to obtain the temporal envelope. The envelope is smoothed (e.g. an FIR-type low-pass digital filter) at step 808 using a smoothing window 810 stored in data memory (e.g. a Hanning or Hamming shaped window). At step 812, transient peaks in the input buffer can be identified and removed to determine a "steady-state" Background Noise Level (BNL). At step 814 an average BNL 816 can be obtained (similar to, or the same as, the RMS) that is frequency dependant or a single value averaged over all frequencies. If the ECM 123 is used to determine the BNL, then decision step 818 adjusts the ambient BNL estimation to provide an equivalent ear-canal BNL SPL, by deducting an Earpiece Noise Reduction Rating 828 from the BNL estimate 826. Alternatively, if the ECM 123 is used, then the Audio Content SPL level (ACL) 822 of any reproduced Audio Content 820 is deducted from the ECM level at step 824. The updated BNL estimate is then converted to a Sound Pressure Level (SPL) equivalent 832 (i.e. substantially equal to the SPL at the ear-drum in which the earphone device is inserted) by taking into account the sensitivity (e.g. measured in V per dB) of either the ASM 111 or ECM 123 at steps 830 and 834 respectively. The resulting BNL SPL is then combined at step 842 with the previous BNL estimate 840, by averaging 838 a weighted previous BNL (weighted with coefficient 836), to give a new ear-canal BNL 844.

Figure 9:
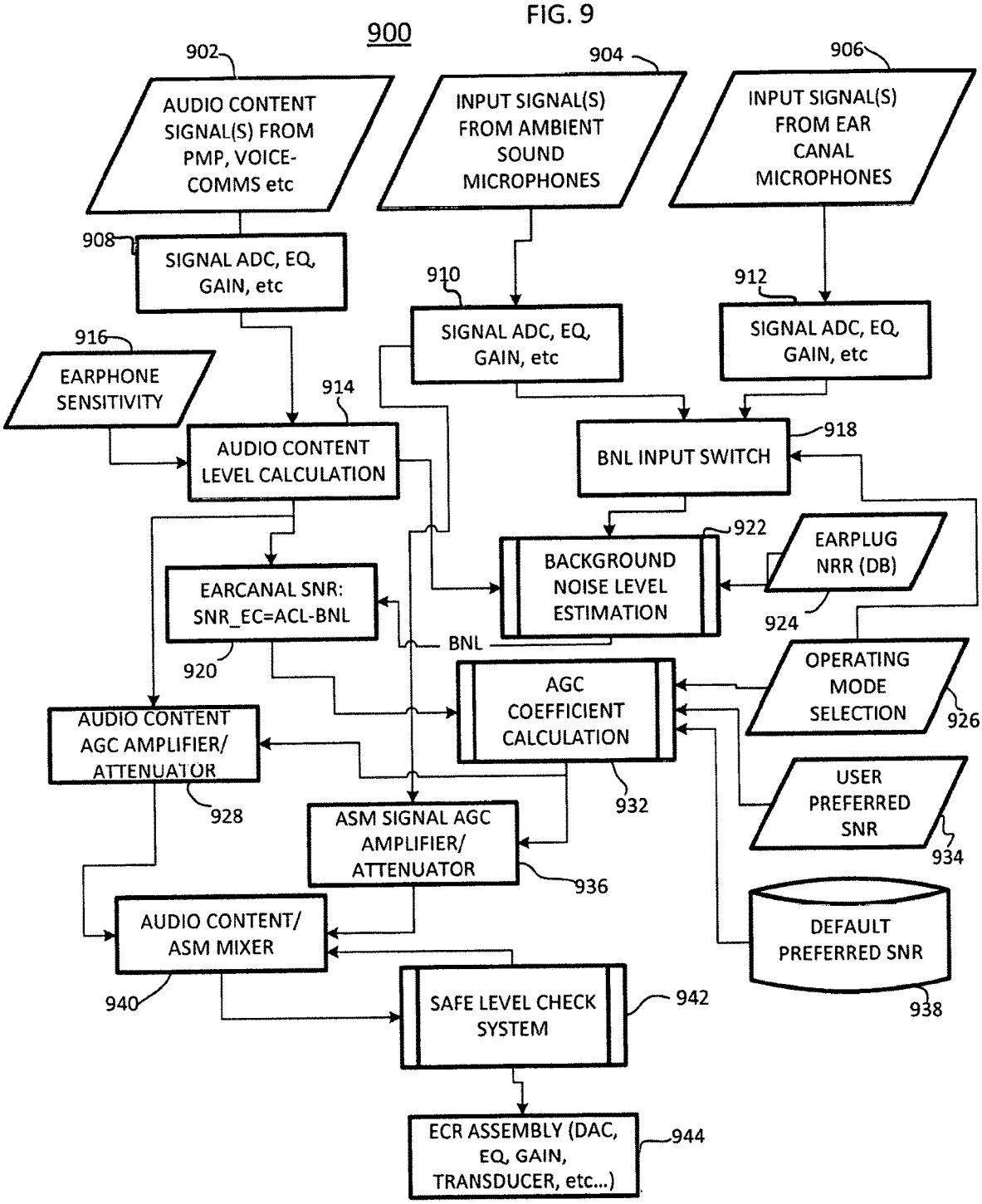
FIG. 9 is a flowchart of a method for maintaining constant audio content level (ACL) to internal ambient sound level (iASL) in accordance with an exemplary embodiment.

FIG. 9 is a flowchart of a method 900 for maintaining constant audio content level (ACL) to internal ambient sound level (iASL). The method 900 can be practiced with more or less than the number of steps shown and is not limited to the order shown. To describe the method 900, reference will be made to components of FIG. 2, although it is understood that the method 900 can be implemented in any other manner using other suitable components. The method 900 can be implemented in a single earpiece, a pair of earpieces, headphones, or other suitable headset audio delivery devices.

Briefly, FIG. 9 describes a method 900 for Constant Signal-to-Noise Ratio (CSNRS). At step 904 an input signal is captured from the ASM 111 and processed at step 910 (e.g. ADC, EQ, gain). Similarly, at step 906 an input signal from the ECM 123 is captured and processed at step 912. The method 900 also receives as input an Audio Content signal 902, e.g. a music audio signal from a portable Media Player or mobile-phone, which is processed with an analog and digital signal processing system as shown in step 908. An Audio Content Level (ACL) is determined at step 914 based on an earpiece sensitivity from step 916, and returns a dBV value.

In one exemplary embodiment, method 900 calculates aRMS value over a window (e.g. the last 100 ms). The RMS value can then be first weighted with a first weighting coefficient and then averaged with a weighted previous level estimate. The ACL is converted to an equivalent SPL value (ACL), which may use either a look-up-table or algorithm to calculate the ear-canal SPL of the signal if it was reproduced with the ECR 125. To calculate the equivalent ear canal SPL, the sensitivity of the ear canal receiver can be factored in during processing.

At step 922 the BNL is estimated using inputs from either or both the ASM signal at step 902, and/or the ECM signal at step 906. The BNL may be adjusted by the earpiece noise reduction rating 924. These signals are selected using the BNL input switch at step 918, which may be controlled automatically or with a specific user-generated manual operation at step 926. The Ear-Canal SNR is calculated at step 920 by differencing the ACL from step 914 and the BNL from step 922 and the resulting SNR 930 is passed to the method step 932 for AGC coefficient calculation. The AGC coefficient calculation 932 calculates gains for the Audio Content signal and ASM signal from the Automatic Gain Control steps 928 and 936 (for the Audio Content and ASM signals, respectively). AGC coefficient calculation 932 may use a default preferred SNR 938 or a user-preferred SNR 934 in its calculation. After the ASM signal and Audio content signal have been processed by the AGCs 928 and 936, the two signals are mixed at step 940.

At step 942, a safe-level check determines if the resulting mixed signal is too high, if it were reproduced with the ECR 125 as shown in block 944. The safe-level check can use information regarding the user's listening history to determine if the user's sound exposure is such that it may cause a temporary or a permanent hearing threshold shift. If such high levels are measured, then the safe-level check reduces the signal level of the mixed signals via a feedback path to step 940. The resulting audio signal generated after step 942 is then reproduced with the ECR 125.

Figure 10:
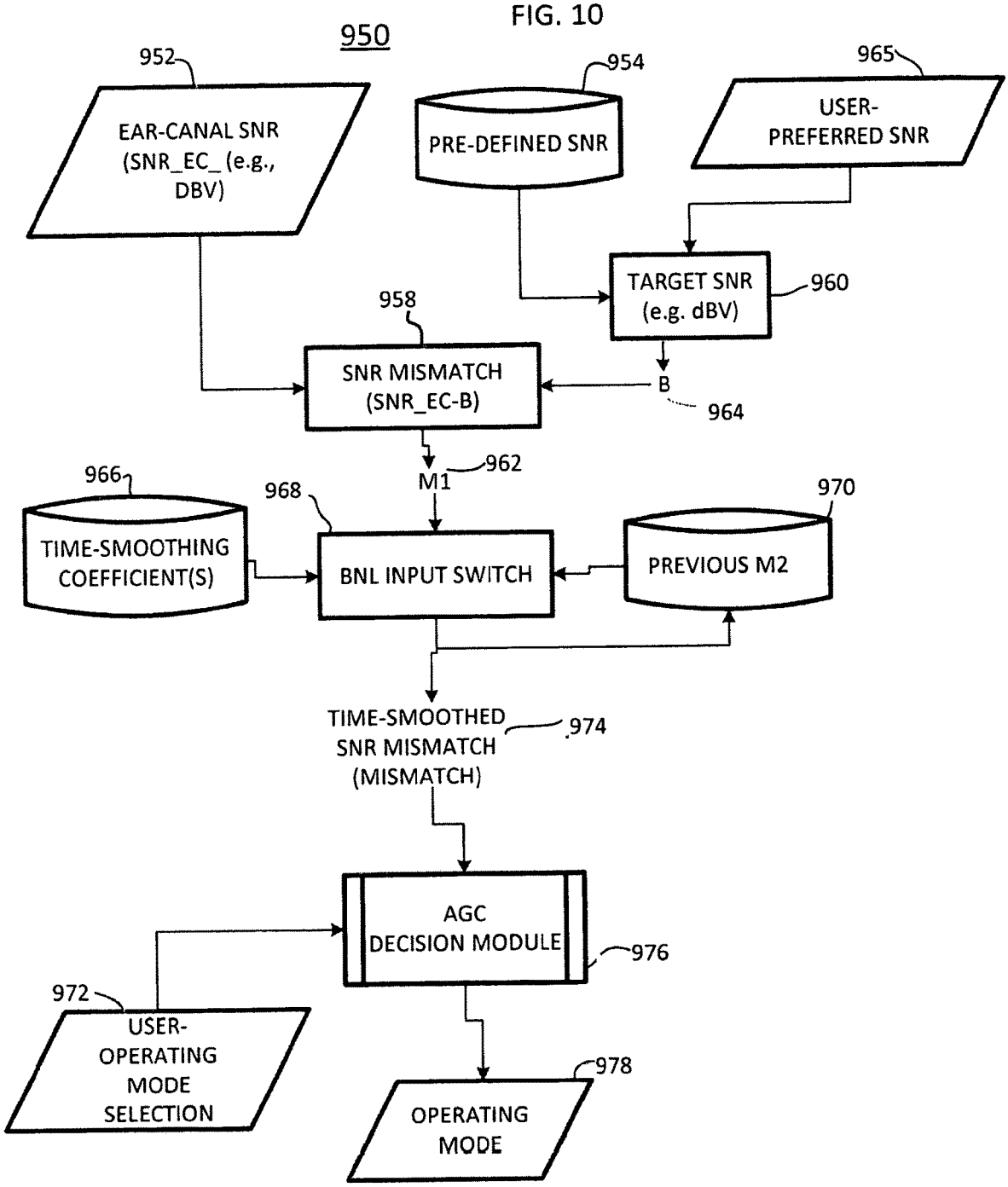
FIG. 10 is a flowchart of a method for adjusting audio content gain in accordance with an exemplary embodiment.

FIG. 10 is a flowchart of a method 950 for maintaining a constant signal to noise ratio based on automatic gain control (AGC). The method 950 can be practiced with more or less than the number of steps shown and is not limited to the order shown. To describe the method 950, reference will be made to components of FIG. 2, although it is understood that the method 950 can be implemented in any other manner using other suitable components. The method 950 can be implemented in a single earpiece, a pair of earpieces, headphones, or other suitable headset audio delivery devices.

Method 950 describes calculation of AGC coefficients. The method 950 receives as its inputs an Ear Canal SNR 952 and a target SNR 960 to provide a SNR mismatch 958. The target SNR 964 is chosen from a pre-defined SNR 954, sorted in computer memory or a manually defined SNR 956. At step 958, a difference is calculated between the actual ear-canal SNR and the target SNR to produce the mismatch 962. The mismatch level 962 is smoothed over time at step 968, which uses a previous mismatch 970 that is weighted using single or multiple weighting coefficients 966, to give a new time-smoothed SNR mismatch 974. Depending on the magnitude of this mismatch, various operating modes 972, 978 can be invoked, for example, as described by the AGC decision module 976 (step 932 in FIG. 9).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions of the relevant exemplary embodiments. Thus, the description of the invention is merely exemplary in nature and, thus, variations that do not depart from the gist of the invention are intended to be within the scope of the exemplary embodiments of the present invention. Such variations are not to be regarded as a departure from the spirit and scope of the present invention.

What is claimed:

1. An earpiece configured to pass through sound from an ambient sound microphone comprising:

a housing, where the housing has a tip end and an ambient environment end;

a processor;

a first microphone configured to measure a first acoustic environment closer to the tip end than the ambient environment end, generating a first microphone signal;

a second microphone configured to measure a second acoustic environment closer to the ambient environment end than the tip end, generating a second microphone signal; and a speaker configured to play an audio content signal, where the processor is coupled to the first microphone, the second microphone and the speaker, and where the processor is configured, if the earpiece has been placed into pass-through mode, to:

modify the first microphone signal to generate a first modified signal;

modify the second microphone signal to generate a second modified signal;

mix the first modified signal, the audio content signal and the second modified signal to generate a mixed signal; and send the mixed signal to the speaker.

2. The earpiece according to claim 1, where the earpiece is placed into pass-through mode when the processor detects an acute sound by examining the temporal or spectral characteristics of a portion of the second microphone signal and the examined portion exceeds a threshold value.

3. The earpiece according to claim 2, where the first microphone is an ear canal microphone.

4. The earpiece according to claim 3, where the second microphone is an ambient sound microphone.

5. The earpiece according to claim 4, where the first modified signal is configured to reduce the noise in the first acoustic environment.

6. The earpiece according to claim 5, where noise is defined as the sound in the first acoustic environment that is not a result of playing the audio content and playing the second modified signal.

7. The earpiece according to claim 6, where the processor is configured to modify the audio content signal prior to generating the mixed signal so that the mixed signal is generated by mixing the first modified signal, the second modified signal and the modified audio content signal.

8. The earpiece according to claim 7, further including:

a safe level check system.

9. The earpiece according to claim 8, where the safe level check system checks if the mixed signal would exceed a safe threshold level if played by the speaker.

10. The earpiece according to claim 9, where the safe level check system reduces the amplitude of the mixed signal if the mixed signal would exceed a safe threshold level if played by the speaker.

11. The earpiece according to claim 4, further including a tip, attached to the tip end of the housing.

12. The earpiece according to claim 11, where the tip is configured to acoustically seal an ear canal when inserted therein.

13. The earpiece according to claim 12, where the tip provides at least 10 dB acoustic isolation from 500 Hz to 4000 Hz.

14. The earpiece according to claim 7, where a modified audio signal is a zero signal.

15. The earpiece according to claim 1, where the earpiece has been placed into pass-through mode by a user operated mode selection.

16. The earpiece according to claim 15, where the first microphone is an ear canal microphone.

17. The earpiece according to claim 16, where the second microphone is an ambient sound microphone.

* * * * *